US005533276A

United States Patent [19]

Vandergriff

[11] Patent Number: 5,533,276

[45] Date of Patent: Jul. 9, 1996

[54] FOUNTAIN DRYER UNIT

[75] Inventor: Arvel L. Vandergriff, Visalia, Calif.

[73] Assignee: Vandergriff, Inc., Visalia, Calif.

[21] Appl. No.: 276,348

[22] Filed: Jul. 18, 1994

[51] Int. Cl.[6] ..... F26B 17/00

[52] U.S. Cl. ..... 34/583; 34/585; 34/590

[58] Field of Search ..... 34/576, 577, 578, 34/579, 580, 582, 585, 583, 586, 588, 589, 590, 594, 360, 368, 375, 376, 168

[56] References Cited

U.S. PATENT DOCUMENTS

| | | | |
|---|---|---|---|
| 790,162 | 5/1905 | Trump | 34/57 |
| 1,475,502 | 6/1922 | Manning | 34/360 |
| 1,778,318 | 10/1930 | Haas | 34/168 |
| 1,840,857 | 1/1932 | Testrup et al. | 34/586 |
| 1,871,773 | 8/1932 | Bennett | 34/168 |
| 2,820,306 | 1/1958 | Smith | 34/168 |
| 4,025,295 | 5/1977 | Touborg | 34/576 |
| 4,096,642 | 6/1978 | Triebel | 34/589 |
| 4,114,289 | 9/1978 | Boulet | 34/168 |
| 4,845,860 | 7/1989 | Jackson . | |

*Primary Examiner*—Henry A. Bennett
*Assistant Examiner*—Susanne C. Tinker
*Attorney, Agent, or Firm*—Wendell Coffee

[57] ABSTRACT

A column of fast moving air with entrained seed cotton is jetted upward from a nozzle in the bottom of a fountain dryer. The column will remain intact until it hits the top of the fountain dryer. At the top, the column will disburse and the mixture of air with entrained cotton will return to the bottom of the dryer in an annulus between the column and the wall of the dryer. There will be an interface of the upward column with the downward annulus. The opposing flows will be roiled and cause turbulence at the interface between the upward column and the downward annulus. The rolling and turbulence will be increased along the walls of the vessel by structure which will reverse the direction of the downward flow of the cotton. The downward flow of the cotton is collected in an annular plenum surrounding the bottom of the column and is directed to an outlet duct. The outlet duct and the annular plenum with the inlet at the center thereof, form a banjo separator.

10 Claims, 2 Drawing Sheets

FOUNTAIN DRYER UNIT

CROSS REFERENCE TO RELATED APPLICATION

None however, Applicant has filed two Disclosure Documents, Number 329,898 filed on Apr. 26, 1993, and 352, 731 on Apr. 25, 1994 which documents concern this application; therefore, by separate paper it is respectfully requested that the document be retained and acknowledgment thereof made by the Examiner.

BACKGROUND OF THE INVENTION

1. Field of the Invention

This invention relates to conditioning fibrous material and more particularly to regulating the humidity of seed cotton in a cotton gin. Cotton ginners have ordinary skill in this art.

2. Description of the Related Art

It is often desirable to condition fibrous material. One of the necessary conditioning steps is to condition seed cotton before it is ginned at a cotton gin. In this context "GIN" sometimes means the step, operation, or procedure by which the cotton lint is separated from the cotton seed. The term, "SEED COTTON" is used to indicate the cotton as harvested before the seed has been separated from the lint. Herein, the term,"FIBROUS MATERIAL" is used to include fibers which are not necessarily spun into yarn or thread or woven or connected by adhesive into a mat.

Seed cotton is a fibrous material according to this application.

It is known that cotton can be processed more easily at certain levels of humidity. It is customary in cotton gins to dry seed cotton if it has excessive moisture or to humidify seed cotton if it is too dry.

Drying systems are well recognized. For example, TRUMP U. S. Pat. Nos. 790,162 and HAAS 1,778,318 disclose dryers.

Also many patents have been issued for drying cotton and particularly seed cotton for example, BENNETT 1,871,773 and SMITH 2,820,306.

JACKSON 4,845,860 discloses a fountain dryer for seed cotton.

It has been recognized that better conditioning, either during drying or humidification, is achieved if there is a relative movement between the air and the fibrous material.

SUMMARY OF THE INVENTION

1. Progressive Contribution to the Art

This invention achieves the desired movement and contact between the conditioning air and the fibrous material by mixing the conditioning air and fibrous material into a single airstream and jetting it vertically upward through a nozzle thus forming a column of air with entrained fibrous material within a closed vessel. The closed vessel has a cross-sectional area greater than the cross-sectional area of the column of fibrous material and conditioning air. The vessel has no interior obstructions between the upward moving column and the surrounding, descending fibrous material in air. Although the column basically will stay intact, the interface between the upward moving column and the downward moving fibrous material and air will cause considerable turbulence. The vessel walls are irregular in shape to increase the turbulence of the downward moving mixture of air and fibrous material. The increased turbulence and slippage (movement of the air with regard to the fibrous material) improve the transfer of moisture.

At the bottom of the vessel there is an annular plenum around the column and the nozzle. The plenum collects the treated material. A horizontal outlet duct is connected to this plenum.

2. Objects of this Invention

An object of this invention is to condition fibrous material as to temperature and humidity.

Another object of this invention is to dry seed cotton.

Further objects are to achieve the above with devices that are sturdy, compact, durable, lightweight, simple, safe, efficient, versatile, ecologically compatible, energy conserving, and reliable, yet inexpensive and easy to manufacture, install, operate, and maintain.

Other objects are to achieve the above with a method that is rapid, versatile, ecologically compatible, energy conserving, efficient, and inexpensive, and does not require highly skilled people to install, operate, and maintain.

The specific nature of the invention, as well as other objects, uses, and advantages thereof, will clearly appear from the following description and from the accompanying drawings, the different views of which are not necessarily scale drawings.

Figures 1, 2:
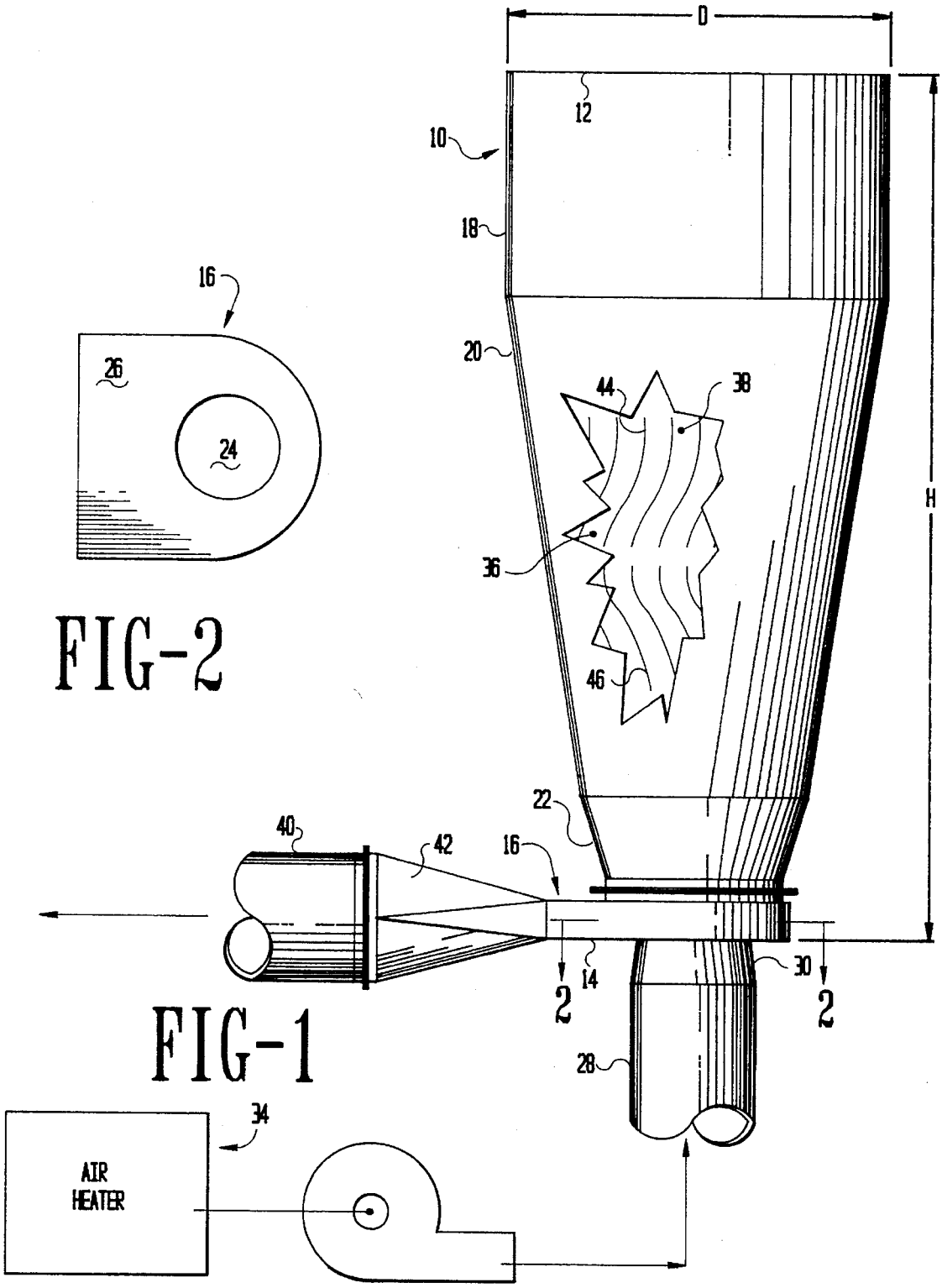
FIG. 1 is a side elevational view partially broken away to show interior construction of this invention.
FIG. 2 is a sectional view taken substantially on line 2—2 of FIG. 1 showing the banjo outlet of this invention.

As an aid to correlating the terms of the claims to the exemplary drawing(s), the following catalog of elements and steps is provided:

H—height
D—diameter
10—vessel
12—top
14—bottom
16—banjo separator
18—cylinder
20—circular-mid sections
22—bottom section
24—inlet
26—bottom plate
28—in conduit
30—nozzle
32—column
34—fan means
36—annulus
38—walls
40—exit
42—transition section
44—vanes
46—vanes

DESCRIPTION OF THE PREFERRED EMBODIMENTS

Referring to the drawing there may be seen a conditioning chamber or vessel 10 for conditioning fibrous material. It will be understood that the conditioning could be either humidity or temperature. Herein the description will be limited to humidity, and more specifically to dry seed cotton.

The vessel 10 would generally be tubular in shape and generally the height "H" of the vessel measured from top 12 to bottom 14 of banjo separator 16 would be twice the diameter "D" of the vessel at its widest point.

Preferably the chamber would have a circular cross section for ease of manufacturing. With circular cross section, basically the vessel is formed of a combination of shapes, namely cylindrical upper section 18 and frustrum surfaces such as mid section 20, and bottom section 22. Sections 18, 20 and 22 are co-axial and also with inlet 24 in bottom plate 26 of the banjo 16. The bottom plate 26 forms the bottom 14 of the vessel 10. Conduit 28 is connected to the inlet 24 by nozzle 30. The nozzle 30 is at the center of the vessel at the bottom.

The purpose of the nozzle is to accelerate the air from the inlet conduit 28, and to shoot it up in high velocity column 32 at the center of the vessel. (Column 32 is not represented in FIG. 1 for clarity) The high velocity column 32 is formed by the jet of air with fibrous material entrained in it going upward at high velocity. A velocity of at least 4,000' per minute has been found to work satisfactorily to maintain a column all the way from the inlet 24 to the top 12. Fan means 34 will supply fibrous material entrained in conditioned air to the inlet conduit 28 at sufficient velocity so that after passing through the nozzle 30 the air with fibrous material entrained therein will be jetted from the nozzle 30 at a velocity of at least 4000' per minute to form said column 32. As used herein the fan means 34 includes not only the fan proper but also the other equipment necessary to condition the air and to entrain the fibrous material therein. By way of an example, for a cotton gin this would be about 6,300 cubic feet a minute, and therefore if the inlet 24 was 17" in diameter this would result in a velocity of 4000' per minute.

The seed cotton, after being jetted upward in a single column 32 to the top 12 would be disbursed at the top 12 and would return downward in annular space 36 between the column 32 and wall 38 of the vessel 10. The mixture of air and fibrous material returns to the banjo separator 16. The mixture is directed through transition section 42 to exit conduit 40.

Figure 3:
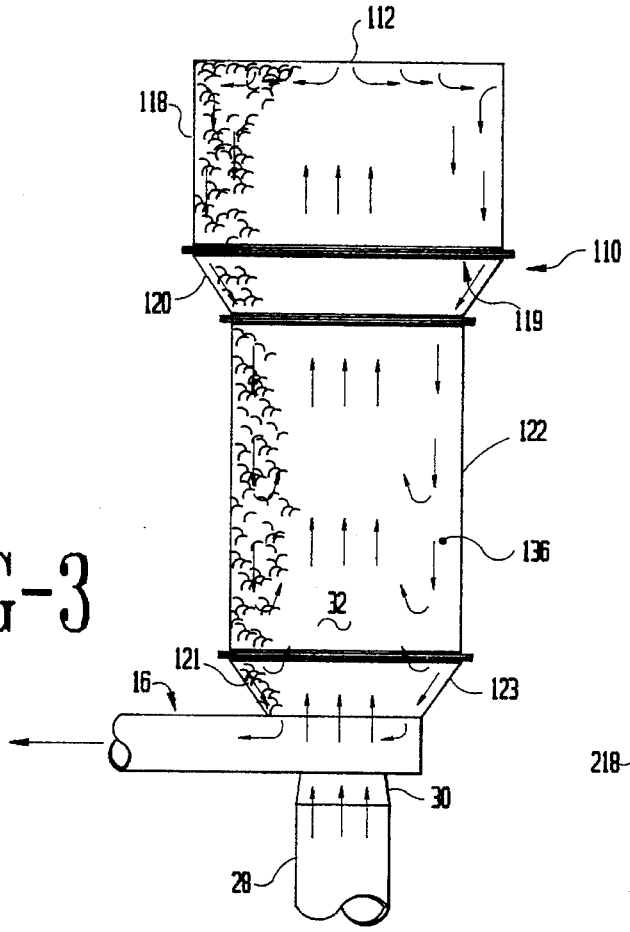
FIG. 3 is a schematic representation of a second embodiment of this invention.

FIG. 3 shows a second embodiment. In the second embodiment it will be understood that there would be the same inlet conduit 28 and nozzle 30 connecting into the bottom 14 of banjo discharge section 16. Vessel 110 has a different configuration from vessel 10. The vessel has top 112 so that the inlet column 32 would be jetted from the nozzle 30 up to the top 112. Cylindrical upper chamber 118 is connected to short frustrum surface 120. However, the section 120 has an abrupt reduction in diameter to the mid-cylindrical section 122. Lower frustrum surface section 123 connects to the banjo section 16. The lower section 123 is also abrupt.

In the drawing of Fig.3 it may be seen because of the abrupt changes of section 120 connecting the cylinders 118 and 122 that there would be turbulent area at 119 where the downward flow of the air and entrained fibrous material would be roiled by the change. Also in the area 121 where there is an abrupt change of the section 123 from the cylindrical section 122, there is another turbulent area where the down flow would be roiled. Friction along the sides of the cylindrical elements 118 and 122 would cause a certain amount of rolling, thereby causing turbulence all along the sides of the vessel. An interface exists between the upward high-velocity movement of the column 32 and the downward flow of the air in the annulus 136. At this interface the flows would be roiled causing turbulence. These areas of turbulence are designed to cause a high degree of slippage or movement between the conditioning air and the fibrous material. It is this movement that accelerates the moisture transfer from the fibrous material to the heated dry air carrying the fibrous material.

Figure 4:
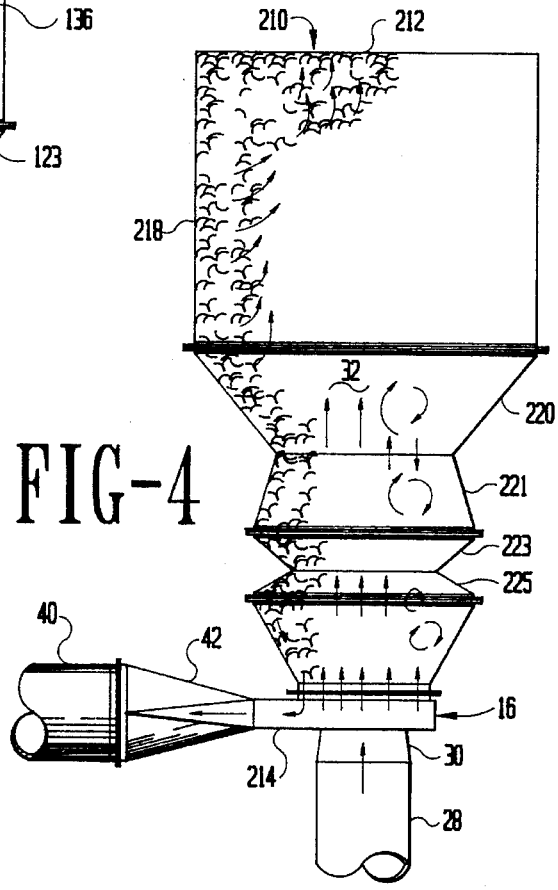
FIG. 4 is a schematic representation of a third embodiment of this invention.

FIG. 4 shows another embodiment. In this instance the vessel 210 includes top 212 and bottom 214 with a banjo separator 16 immediately above the bottom. The banjo separator is connected by transitional section 42 to an exit conduit 40. The mixture of air and fibrous material is accelerated by the nozzle 30 from the inlet conduit 28. The conduit and the nozzle will form a high-velocity upward column of air mixture 32 which will impinge against the top 212 and disburse within an upper cylindrical section 218. At the bottom of 218 a frustrum surface 220 will roil the downward flow within the annulus. Below, there is a section of direction reversal. I.e., the frustrum surface 221 will reverse the downward flow which, within the section 220 was toward the center of the vessel, so that at the frustrum section 221 it is reversed to go outward. Again within the section 223 the downward flow is again reversed to go inward. Immediately below that in section 225 the downward flow is reversed to go outward. These reversals of flow will cause a rolling of the flow resulting in the desired turbulence and slipping.

Referring back to the FIG. 1, it may be seen that where the surface of the section 20 has been broken away that a series of vanes 44 have been placed within the section. These vanes 44 tend to rotate the downward flow in a counter-clockwise direction as viewed from the top. An additional section of a series of vanes 46 attached to the side of the vessel would tend to rotate the downward flow in a clockwise direction. I.e., there would be a reversal of the flow between the vanes 44 and the vanes 46. This would also roil the flows, causing turbulence.

The vanes 44 and 46 are not necessary to roil the downward flow; however, they are considered desirable.

Thus it may be seen that structure and process has been provided to condition fibrous material carried within an airstream.

The embodiments shown and described above are only exemplary. I do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

I claim as my invention:

1. Structure for conditioning seed cotton comprising:

a) a tubular exposure closed chamber having a height and a width; the height being more than twice the width, b) said chamber having a closed top and having an opening in a bottom thereof, c) an inlet conduit connected to said opening in the bottom with d) a nozzle located at the center of the bottom of the chamber and pointing upward, e) fan means connected to the inlet conduit for supplying treated air suspending seed cotton to be treated therein, f) said fan means capable of jetting the treated air at a velocity more than 4000' per minute from the nozzle, g) a cross-sectional area of the chamber being more than 9 times as great as the cross-sectional area of the nozzle, h) an outlet duct extending horizontally at the bottom of the chamber, i) the cross-sectional area of the chamber at the bottom being more than 3½ times the cross-sectional area of the nozzle, and j) the chamber tapering upward and outward from the outlet duct.

2. Structure as defined in claim 1 further comprising:

k) rolling means in the vessel for causing turbulent airflow.

3. Structure as defined in claim 1 further comprising:

k) reversing means in the vessel for reversing the direction of airflow along the walls of the vessel.

4. Structure as defined in claim 3 wherein said reversing means is in the form of l) vanes on the vessel wall, m) some of said vanes directing the airflow in a clockwise direction and n) some of said vanes directing the airflow in a counter-clockwise direction.

5. Structure as defined in claim 3 wherein said reversing means includes l) a portion of the walls sloping, m) some of said portions sloping toward the center, and n) some of said portions sloping away from the center.

6. Structure for conditioning seed cotton including a) a source of a mixture of conditioning air and seed cotton, and b) a duct connecting said source to c) a vessel having a center, and d) walls;

e) wherein the improvement comprises in combination with the above:

f) said vessel being closed and having
i a closed top,
ii a bottom, and
iii an annular plenum around
iv an inlet in the bottom at the center of the vessel, g) a nozzle connecting the duct to the inlet, and h) an outlet duct connected to the plenum, so that there is an airflow from the nozzle in an upward direction to the closed top and then in a downward direction along the walls to the plenum.

7. Structure as defined in claim 6 further comprising:

j) rolling means in the vessel for causing turbulent airflow.

8. Structure as defined in claim 6 further comprising:

j) reversing means in the vessel for reversing the direction of airflow along the walls of the vessel.

9. Structure as defined in claim 8 wherein said reversing means is in the form of k) vanes on the vessel wall, l) some of said vanes directing the airflow in a clockwise direction and m) some of said vanes directing the airflow in a counter-clockwise direction.

10. Structure as defined in claim 8 wherein said reversing means includes k) a portion of the walls sloping, l) some of said portions sloping toward the center, and m) some of said portions sloping away from the center.

* * * * *